United States Patent [19]

Kroeker

[11] 4,183,521

[45] Jan. 15, 1980

[54] EXERCISING DEVICE

[76] Inventor: Delbert R. Kroeker, RR #1, Westboro, Wis. 54490

[21] Appl. No.: 873,793

[22] Filed: Jan. 31, 1978

[51] Int. Cl.[2] ..... A63B 7/00

[52] U.S. Cl. ..... 272/146; 272/111

[58] Field of Search ..... 272/70, 109, 111, 96, 272/97, 93, 94, 116, 134, 146, 55, 56, 52, 52.5, 53.1, 53.2, 54, 144, 145, 1 C, 33 R; 297/270, 258, 273, 281, 282, 349

[56] References Cited

U.S. PATENT DOCUMENTS

| | | | |
|---|---|---|---|
| 1,395,698 | 11/1921 | Baum et al. | 272/56 UX |
| 2,871,015 | 1/1959 | Block | 272/56 X |
| 3,020,046 | 2/1962 | Hotas | 272/96 |
| 3,164,382 | 1/1965 | Johnson | 272/33 R |
| 3,207,510 | 9/1965 | Gibson | 272/97 |
| 3,212,790 | 10/1965 | Burling | 272/33 X |
| 3,331,631 | 7/1967 | Pierson, Jr. | 297/258 |
| 3,604,726 | 9/1971 | Tracy | 272/146 X |
| 3,612,520 | 10/1971 | Chang et al. | 272/111 X |
| 3,936,047 | 2/1976 | Brandt et al. | 272/146 |

FOREIGN PATENT DOCUMENTS

| | | | |
|---|---|---|---|
| 2503728 | 1/1975 | Fed. Rep. of Germany | 272/97 |

*Primary Examiner*—Richard C. Pinkham
*Assistant Examiner*—Arnold W. Kramer
*Attorney, Agent, or Firm*—James R. Cwayna

[57] ABSTRACT

A device for exercising or developing balance, the device including a rockable support member provided by arcuately formed supports, a rotatable cross bar extending between the upper ends of the supports with the bar being selectively rotatable and the bar carrying a support plate upon which the user may stand. The support plate is also rotatable. The combined, available movements between the rockable support member, the rotatable cross bar and the support plate provides a tri-axial possibility for the user. The rotatable bar is lockable in a non-rotative position or limited rotation or full rotation.

6 Claims, 8 Drawing Figures

FIG. 1
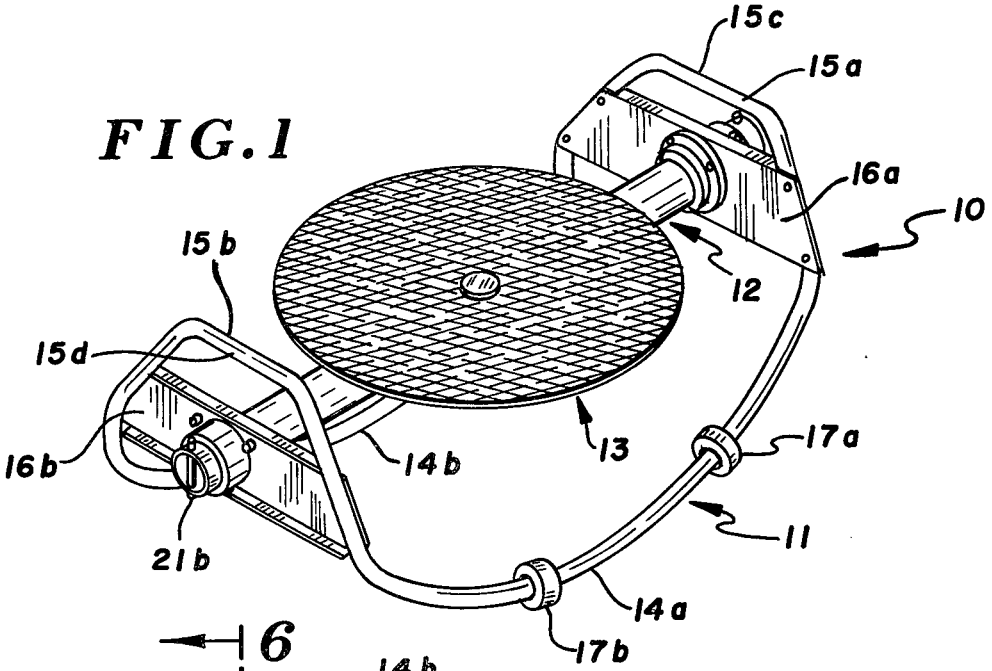
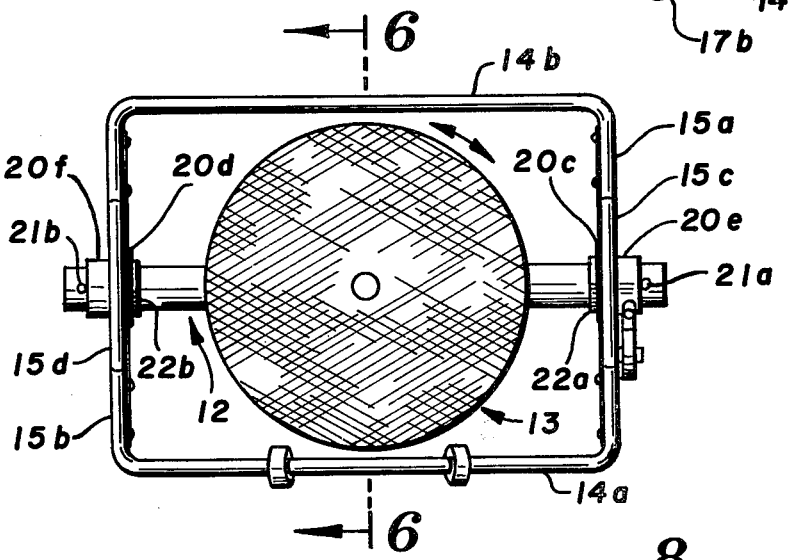
FIG. 2
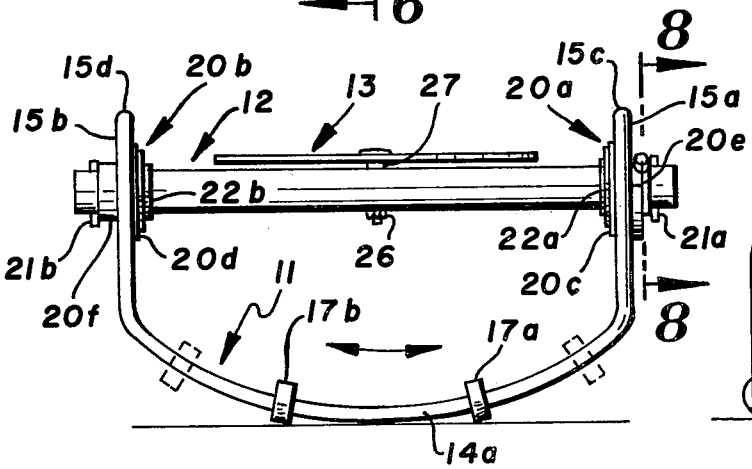
FIG. 3
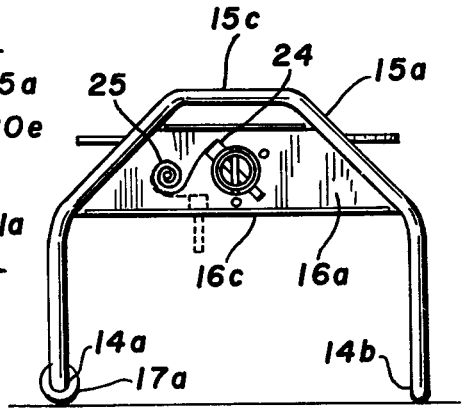
FIG. 4

EXERCISING DEVICE

FIELD OF THE INVENTION

This device relates generally to exercising devices requiring a balancing technique and more particularly to an exercising device which includes movement and control in a tri-axial relation.

BACKGROUND AND OBJECTS OF THE INVENTION

Many devices in the exercising field have been developed to assist persons in further developing coordination and balance for the entire body. Many of such units have been specifically developed for use in minimal space areas and as such do not require gymnasium facilities. In many sporting activities, such as skiing and the like, a high degree of balance is required and most apparatus units do not provide a degree of useage which will provide for movement in, what may be termed three dimensional or total movement. The concept of total movement varies from the three dimensional concept in that total movement may include singular, double or triple axle movement and also include the various combinations thereof. With the applicant's device as provided herein such exercising movements are attainable.

Comparable prior art includes devices known as "Bongo Boards" and swivel board devices which are sold under a variety of commercial names. All of these devices provide for, and require, a balancing technique but similarly, they are all limited to minimal dimensional or axial movement.

With applicant's device, the user is free to select a certain degree of moveability by limiting the movement of at least one or several of the alternate elements of the device and thereby the proficiency of the user is easily modified from a beginning status to that of an advanced user.

It is therefore an object of applicant's device to provide an exercising device which incorporates a first rocking element arranged to rock in a first direction and having a supporting platform thereon such that a user may stand thereon and control the rocking action thereof.

It is a further object of applicant's invention to provide an exercising device which incorporates a first rocking element arranged to rock in a first direction and having a supporting platform thereon, such platform being rotatably mounted such that a user standing thereon will be confronted with the control of both a turning and a rocking motion.

It is still a further object of applicant's invention to provide an exercising device which incorporates a first rocking element arranged to permit rocking motion in a first direction or plane, a first rotatable element arranged for rotation in at least a limited degree and a supporting platform rotatably mounted on the first rotatable element.

It is still a further object of applicant's invention to provide an exercising device which incorporates a first rocking element arranged to permit rocking motion in a first direction or plane, a rotatable cross member extending longitudinally of the rocking element and a supporting platform which is rotatably mounted on the rotatable cross member.

It is yet a further object of applicant's invention to provide an exercising device which incorporates a first rocking element arranged to permit rocking motion in a first direction or plane, a rotatable cross member extending longitudinally of the rocking element and a supporting platform which is rotatably mount on the rotatable cross member with means for selectively limiting the degree of rocking of the rocking element and means for selectively limiting rotation of the rotatable cross member.

These and other objects and advantages of applicant's invention will more fully appear from the accompanying disclosure made in connection with the accompanying drawings in which the same numerals are used to designate the same or similar parts throughout the several view, and in which:

FIG. 1 is a perspective view of the exercising device embodying the concepts of applicant's invention as the same is disclosed herein;

FIG. 2 is a top plan view of the exercising device with an indicating arrow being utilized to show the directions of rotation of the supporting platform thereof;

FIG. 3 is a side elevation of the exercising device with an indicating arrow being utilized to show the rocking motion of the device;

FIG. 4 is an end view of the device;

Figure 5:
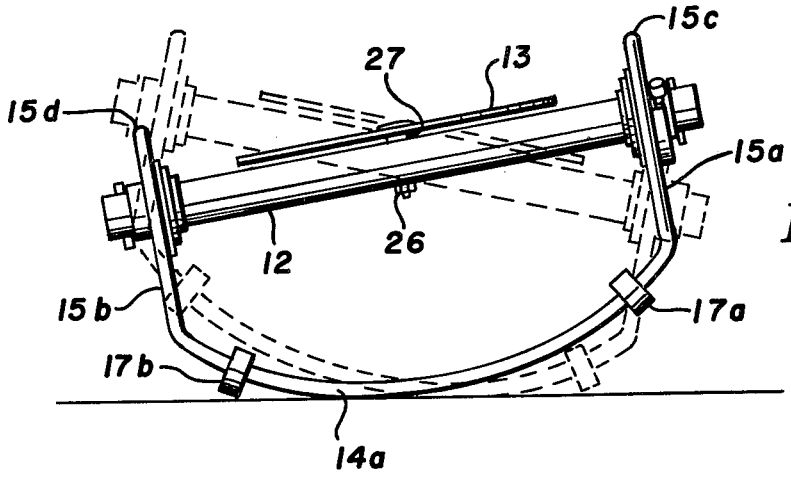
FIG. 5 is a side elevation of the device, similar to FIG. 3 and illustrating the rocking movement thereof.

In accordance with the accompanying drawings, applicant's exercising device is designated in its entirety 10 and the functions and useages thereof for full balancing exercise are basically controlled by a rocking section 11, a rotatable cross bar section 12 which is pivotally or rotatably mounted on the respective ends of the rocking section 11 and a user supporting platform portion 13 which is rotatably mounted on the rotatable cross bar 12. The entire use of the unit should be obvious to one skilled in the art from simply viewing the illustration of FIG. 1 and from the simple description given above. The user will be supported upon the platform 13 and will try to maintain balance against the various movements that are available with the more accomplished user being able to control the movements to exercise as they desire.

The rocking section 11, in the form shown, includes a pair of spaced, arcuately formed rocker members **14*a*, 14*b* formed at their upper ends to provide a substantially trapezoidally formed connective portion 15*a*, 15*b* to connect the rocker portions 14*a*, 14*b*. It should be obvious that this same spacing of the rockers with the upward extension could be accomplished through a triangular or rectangular configuration as the device 10 would be viewed from the ends thereof. With the trapezoidal joining configurations 15*a*, 15*b*, a horizontal section 15*c*, 15*d* is provided at the ends of the device 10 and these horizontal elements provide a grasping means for the user and these grasping elements 15*c*, 15*d*** will assist the user in either mounting the unit for upstanding useage or may be used by the user to use the device in a crouching position.

As particularly illustrated in FIG. 4, plate members 16a, 16b are provided to extend between the trapezoidal end sections 15a, 15b and these plate members serve to both strengthen the unit and to provide mounting areas for the rotatable cross bar section 12 of the unit.

As illustrated in the various figures, stop elements such as enlarged tubular sections 17a, 17b are provided on at least one of the rocker elements 14a, 14b and these tubular elelents 17a, 17b are selectively locateable along the rockers to limit the rocking movement of the device.

In the form shown, the rocker elements and the upstanding end portions thereof may be formed from tubing or similar round material although the shape of the material used is of minimal import, the import aspect being to provide the rocker section with means for supporting the remaining portions of the device.

The rotatable cross bar section 12 is mounted for rotation through the aforementioned plate members 16a, 16b such that the same is provided in the same plane as the rocking movement of the device but which obviously result in a rocking or rotating motion which is transverse to this rocking plane.

A pair of trunnion members 20a, 20b are provided respectively through each of the plate members 16a, 16b and each trunnion is provided with an enlarged inner shoulder portion 20c, 20d with a reduced portion 20e, 20f thereof arranged to extend through the plates 16a, 16b. The rotatable, supporting cross bar 12 is received through the trunnions 20a, 20b and pin members 21a, 21b are provided through the bar 12 to maintain the same against axial movement. Inwardly of the enlarged shoulders 20c, 20d of the trunnions 20a, 20b friction reducing and axial movement preventing enlargements 22a, 22b may be provided on the bar 12.

Figure 6:
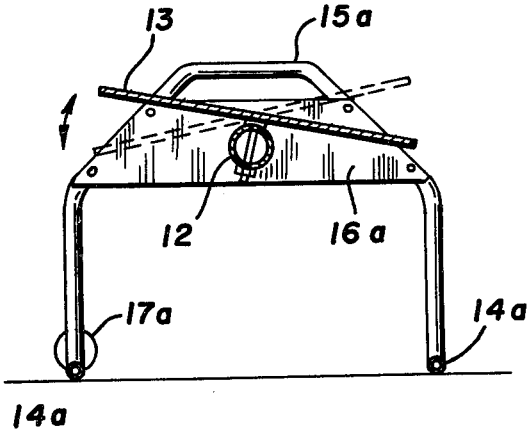
FIG. 6 is an end view of the device, similar to FIG. 4 and illustrating the shiftability of the platform portion thereof in a first limited degree of rotation.
Figure 7:
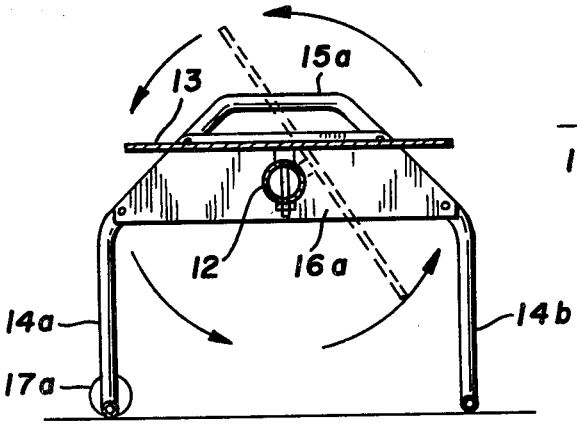
FIG. 7 is an end view of the device, similar to FIGS. 4 and 6 and illustrating the rotatability of the platform through its entire degree of rotation; and, FIG. 8 is a vertical section taken substantially along Line 8—8 of FIG. 3 and being drawn to an enlarged scale.
Figure 8:
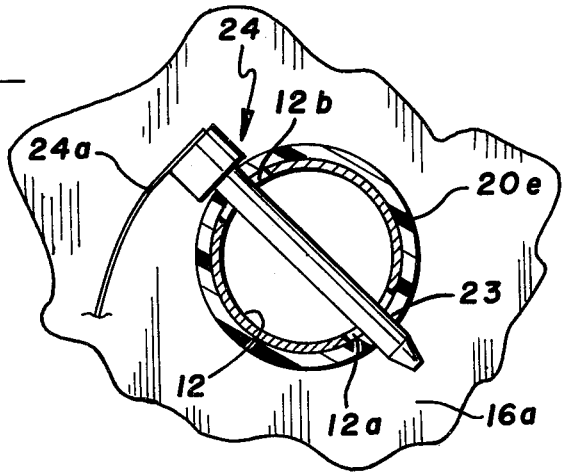

As stated, the movement or rotation of the bar 12 may be selectively chosen. The degrees of selectivity are illustrated in FIGS. 6 and 7. The structure for such limitation and selectivity is illustrated in FIG. 8. As shown therein, the bar 12 is preferably tubular and a pair of diametrically opposed, arcuate slots 12a, 12b are formed therethrough. A mating passage is formed through the trunnion portion 20e and a removable pin member 24 is placed therein. With pin 24 in such position, it is obvious that the rotation of the bar 12 is limited to the movement permitted by the arcuate slots 12a, 12b. When the pin 24 is removed, the movement or rotation of the bar is unlimited. This comparison is shown in FIGS. 6 and 7. Although this pin structure is shown and discussed as being applied to one end of the bar 12, it should be obvious that this structure could be applied to both ends of the unit without departing from the scope of this invention, the concept being to provide selective limits of rotation for the bar 12.

Applicant has also provided a means for retaining this pin 24 when the same is not being used as a limiting element. The arrangement for this concept is illustrated in FIG. 4. A coil spring 25 is provided with one end thereof attached to the plate 16a and the other end thereof attached to an enlarged head portion 24a of the pin 24. The normal action of the spring 25 will be to urge the pin into the locking portions of the trunnion and the bar. When the pin 24 is not in such limiting or locking position, it is positioned in an aperture provided in a flange portion 16c of the plane 16a. This particular position is illustrated by the dotted line portion of FIG. 4. It should be noted that the spring tension and the action thereof is chosen to hold the pin 24 in either of the two selected positions, ie locking or storage.

Although the applicant has chosen to illustrate only one degree of selectivity of rotation for the bar 12, it should be obvious that various degrees of selectivity could be provided through the provision of various slots and passages through the bar 12 and the trunnion portions 20e.

The user supporting platform section 13 provides, in the form shown, a circular disc mounted for rotation with an attachable axle member 26 which extends through an aperture through the bar 12. A spacing element 27 may be provided between the bar 12 and the circular platform 13 such that the platform is easily rotatable. To insure that the user will not slip from the platform 13, a nonskid surface should be provided and preferably, the edges of the disc should be formed in a manner to prevent injury. Many configurations may be utilized to achieve these results.

The use of the device should be obvious. The user will place the device on a suitable surface for rocking and will select the degree of rocking desired by positioning the enlarged elements 17a, 17b which will serve as stop elements. The user will also select the rotatability desired for the rotating cross bar 12. Depending upon the skill of the users, they will mount the platform 13 by grasping the handle elements 15c, 15d of the device and placing their feet on the platform. The user may then rise to a standing position, remain in the crouched-hand grasping position or simply remain in the crouched position. Again, depending upon the experience of the user, maintaining ones balance or challenging the various available movements of the device may be the users desire but the degree of challenge is adjustable and the exercise gained through useage of the device will be beneficial to both those that are in athletic training or are simply interested in exercising.

It should be obvious that applicant has provided a new and unique exercising device which provides a unique structure for obtaining a plurality of directional movements and thus resulting exercises.

What I claimed is:

1. An exercising device, said device including:

a. a supporting base including a pair of spaced, arcuately formed rockers, the rocking motion being in a first plane, said rockers being provided with generally upstanding ends joined to form a common end structure;

b. a cross bar member extending between the common end structures of the said rockers to lie within the plane of rocking motion of said rockers and being mounted for rotation transversely of the plane of rocking motion of said rockers; and, c. a user support platform mounted for rotation on said cross bar member, the axis of rotation of said user platform being generally normal to the axis of said cross bar member.

2. The structure set forth in claim 1 and handle means being formed on the respective ends of said common ends of said rocker members.

3. The structure set forth in claim 1 and stop means shiftably mounted on at least one of said arcuately formed rockers whereby the rocking motion thereof may be selectively controlled.

4. The structure set forth in claim 1 and means to control the rotation of said cross bar member.

5. The structure set forth in claim 1 and means to selectively limit the degree of rotation of said cross bar member.

6. The structure set forth in claim 1 and said user support platform including a non-skid surface.

* * * * *